US007813663B2

(12) United States Patent
Cho

(10) Patent No.: US 7,813,663 B2
(45) Date of Patent: Oct. 12, 2010

(54) SYSTEM AND METHOD OF CONTROLLING TEMPERATURE OF FIXING UNIT BASED ON DETECTED CURRENT

(75) Inventor: Jun-seok Cho, Gwangmyeong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 132 days.

(21) Appl. No.: 11/673,196

(22) Filed: Feb. 9, 2007

(65) Prior Publication Data

US 2007/0230981 A1 Oct. 4, 2007

(30) Foreign Application Priority Data

Apr. 3, 2006 (KR) ..... 10-2006-0030149

(51) Int. Cl.
*G03G 15/20* (2006.01)

(52) U.S. Cl. ..... 399/69

(58) Field of Classification Search ..... 399/69, 399/320, 70; 219/216
See application file for complete search history.

(56) References Cited

U.S. PATENT DOCUMENTS

2003/0155349 A1 8/2003 Matsuo et al.
2004/0028422 A1 2/2004 Umezawa et al.
2005/0058467 A1 3/2005 Sasamoto et al.
2005/0169658 A1 8/2005 Hanamoto et al.

FOREIGN PATENT DOCUMENTS

| | | |
|---|---|---|
| JP | 09-080961 | 3/1997 |
| JP | 09-319250 | 12/1997 |
| JP | 10-20711 | 1/1998 |
| JP | 2000-172107 | 6/2000 |
| JP | 2003-217794 | 7/2003 |
| JP | 2003217794 A * | 7/2003 |
| JP | 2004-303466 | 10/2004 |
| KR | 2005-29516 | 3/2005 |

OTHER PUBLICATIONS

Korean Office Action dated Jun. 12, 2007 issued in KR 2006-30149.
European Search Report dated Jul. 5, 2007 issued in EP06126765.4.

* cited by examiner

*Primary Examiner*—Quana M Grainger
(74) *Attorney, Agent, or Firm*—Stanzione & Kim LLP

(57) ABSTRACT

A system and method of controlling a temperature of a fixing unit, the system includes a current detector to detect a current of an input power to heat a heating roller, a switching unit to switch a supply of the input power to the heating roller, and a controller to control a switching operation of the switching unit according to an instantaneous current detected by the current detector.

45 Claims, 6 Drawing Sheets

SYSTEM AND METHOD OF CONTROLLING TEMPERATURE OF FIXING UNIT BASED ON DETECTED CURRENT

CROSS-REFERENCE TO RELATED APPLICATIONS

This application claims priority under 35 U.S.C. §119(a) from Korean Patent Application No. 10-2006-0030149, filed on Apr. 3, 2006, in the Korean Intellectual Property Office, the disclosure of which is incorporated herein in its entirety by reference.

BACKGROUND OF THE INVENTION

1. Field of the Invention

The present general inventive concept relates to an image forming device, such as a laser printer or a photocopier, to heat a fixing unit using alternating current (AC) power, and more particularly, to a system and method of controlling a temperature of a fixing unit to reduce an instantaneous heating time of the fixing unit and reduce a flicker characteristic.

2. Description of the Related Art

A general fixing circuit used for laser printers and photocopiers includes a controller determining whether power is supplied to a fixing unit, a triac switching unit for applying alternating current (AC) power to the fixing unit, and a triac driver controlling a triac. The general fixing circuit performs simple temperature control of the fixing unit by receiving AC power from an input power supply and applying the AC power to components of the fixing unit. That is, the controller detects a temperature of the fixing unit using a temperature sensor, outputs a switch-on signal if it is determined that a temperature increase is needed, and applies the AC power to the fixing unit by activating the triac to an on-state at a zero-crossing time in every switching period using a photo triac in response to the switch-on signal.

As described above, in the general fixing circuit, since the controller simply controls the triac switching unit in order to control the temperature of the fixing unit, without having information on the AC power, irregular turn-on timing causes a flicker characteristic due to having no information on a voltage sync angle (or a sync angle between voltage and current) of the AC power. A flicker characteristic is an instantaneously flickering phenomenon of a display device using the same power source as an image forming device.

In addition, to reduce a print ready time, a supply of relatively high power may be needed in an initial warm-up of the fixing unit. However, this power increase causes an excessive inrush current, resulting in a more pronounced flicker characteristic.

SUMMARY OF THE INVENTION

The present general inventive concept provides a system and method of controlling a temperature of a fixing unit in order to reduce an instantaneous heating time of the fixing unit and to improve a flicker characteristic.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a system to control a temperature of a fixing unit useable in an image forming apparatus, the system including a current detector to detect a current of an input power to heat a heating roller, a switching unit to perform a switching operation to switch a supply of the input power to the heating roller, and a controller to control the switching operation of the switching unit in response to an instantaneous current detected by the current detector.

The foregoing and/or other aspects and utilities of the present general inventive concept may also be achieved by providing a method of controlling a temperature of a fixing unit, the method including detecting a current of an input power to heat a heating roller, and controlling a switching operation of a switching unit to switch a supply of the input power in response to a detected instantaneous current of the input power.

The foregoing and/or other aspects and utilities of the present general inventive concept may also be achieved by providing a system to control a temperature of a fixing unit of an image forming apparatus, the system including a current detecting unit to detect a current of an input power, a voltage detecting unit to detect a voltage of the input power, a switching unit to switch a power of the input power to a fixing unit, and a control unit to control the switching unit to switch between a turn-on state and a turn-off state according to the detected current and the detected voltage.

The current detecting unit may detect an instantaneous current and a mean current of the input power as the current, and the controller may control the switching unit according to the detected instantaneous current and mean current. The voltage detecting unit may detect a sync signal of a mean value as the voltage of the input power, and the control unit may control the switching unit according to the detected sync signal and the mean value. The system may further include a temperature detecting unit to detect a temperature of the fixing unit, and the control unit may control the switching unit to switch between the turn-on state and the turn-off state according to the detected temperature.

The control unit may control the switching unit to switch between the turn-on state and the turn-off state according to the detected current during a first time period, may control the switching unit to switch between the turn-on state and the turn-off state according to the detected voltage during a second time period, and may control the switching unit to switch between the turn-on state and the turn-off state according to the detected temperature during a third time period.

The control unit may include a first controller to control the switching unit to switch between the turn-on state and the turn-off state based on the detected current during the first time period, a second controller to control the switching unit to switch between the turn-on state and the turn-off state based on the detected voltage during the second time period, and a third controller to control the switching unit to switch between the turn-on state and the turn-off state based on the detected temperature during the third time period.

The second time period may be a time period during which a voltage variation of the input power occurs. The first time period may be shorter than at least one of the second time period and the third time period. The second time period may be longer than the first time period and shorter than the second time period. The third time period may be longer than at least one of the first time period and the second time period.

The foregoing and/or other aspects and utilities of the present general inventive concept may also be achieved by providing a method of controlling a temperature of a fixing unit of an image forming apparatus, the method including detecting a current of an input power, detecting a voltage of the input power, and controlling a switching unit to switch between a turn-on state to supply the input power to the fixing unit and a turn-off state to prevent the supply of the input power to the fixing unit according to the detected current and the detected voltage.

The method may further include detecting a temperature of the fixing unit, and controlling the switching unit to switch between the turn-on state and the turn-off state according to the detected temperature. The method may further include controlling the switching unit to switch between the turn-on state and the turn-off state according to the detected current during a first time period, controlling the switching unit to switch between the turn-on state and the turn-off state according to the detected voltage during a second time period, and controlling the switching unit to switch between the turn-on state and the turn-off state according to the detected temperature during a third time period.

The foregoing and/or other aspects and utilities of the present general inventive concept may also be achieved by providing a computer readable recording medium storing a computer readable program to execute a method of controlling a temperature of a fixing unit of an image forming apparatus, the method including detecting a current of an input power, and controlling a switching unit to switch between a turn-on state to supply the input power to the fixing unit and a turn-off state to prevent the supply of the input power to the fixing unit based on the detected current.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
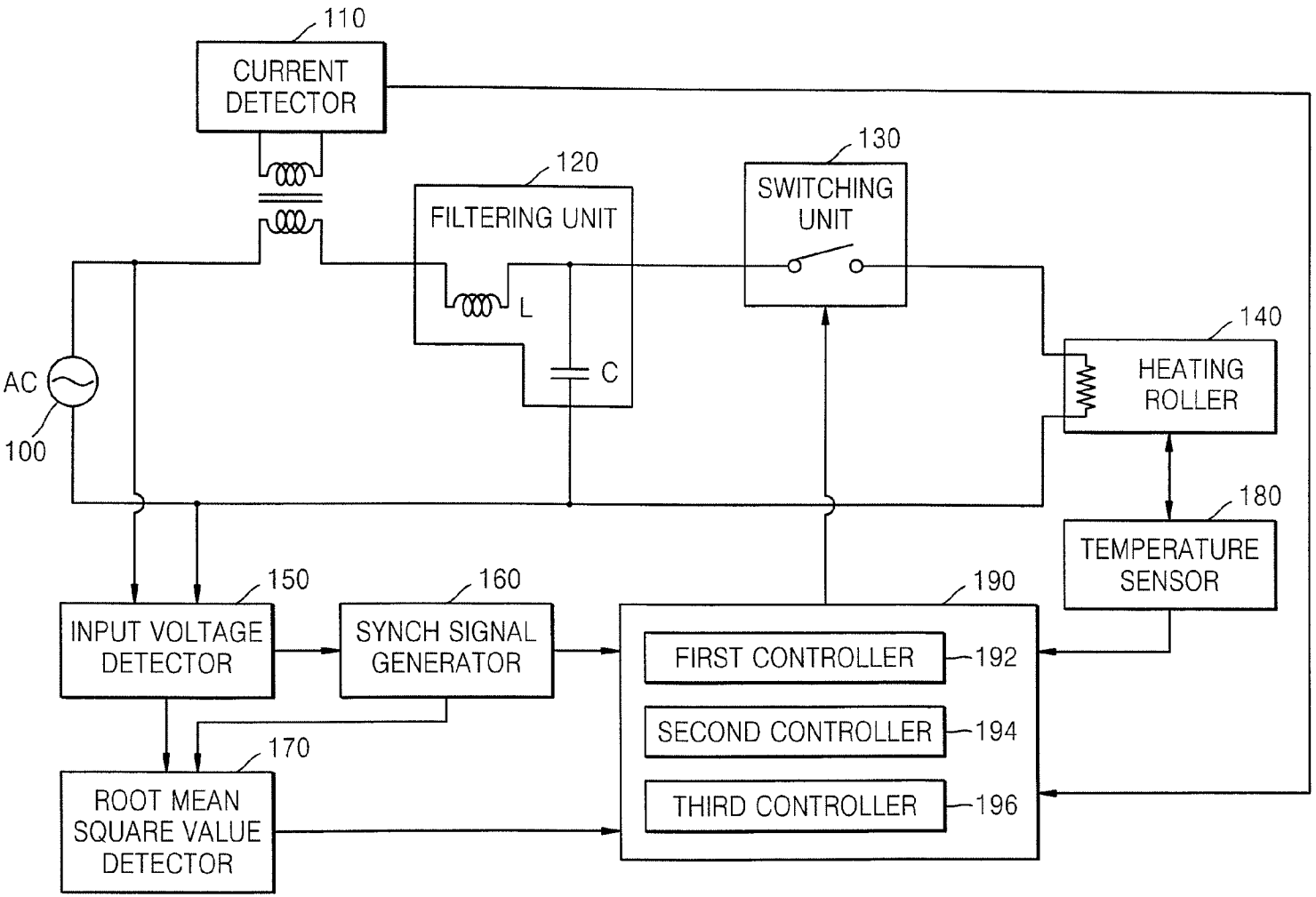
FIG. 1 is a block diagram illustrating a system to control a temperature of a fixing unit, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating a system of controlling a temperature of a fixing unit, according to an embodiment of the present general inventive concept. Referring to FIG. 1, the system may include a power supply 100, a current detector 110, a filtering unit 120, a switching unit 130, a heating roller 140, an input voltage detector 150, a synch (i.e., sync or synchronization) signal generator 160, a root mean square (RMS) value detector 170, a temperature sensor 180, and a controller 190.

The power supply 100 supplies alternating current (AC) power as an input power to heat the heating roller 140.

The current detector 110 detects a current of the input power supplied from the power supply 100.

Figure 2:
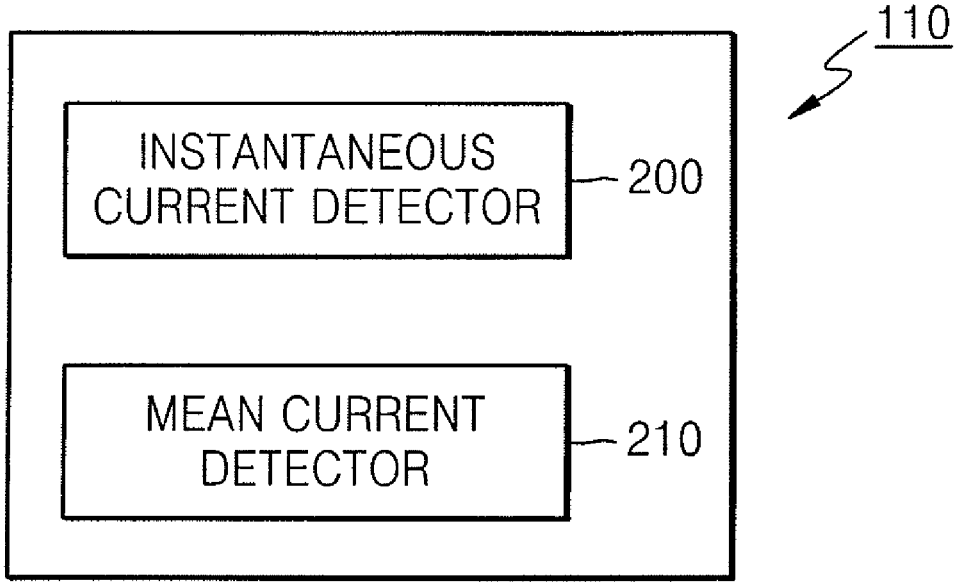
FIG. 2 is a block diagram illustrating a current detector of the system illustrated in FIG. 1, according to an embodiment of the present general inventive concept.

FIG. 2 is a block diagram illustrating the current detector 110 of the system illustrated in FIG. 1, according to an embodiment of the present general inventive concept. Referring to FIG. 2, the current detector 110 includes an instantaneous current detector 200 and a mean current detector 210.

The instantaneous current detector 200 detects an instantaneous current of the input power and outputs a detection result to the controller 190. The instantaneous current detector 200 may include a full rectification circuit. The full rectification circuit can be formed using, for example, a plurality of diodes and a transformer or using a bridge rectification circuit.

The mean current detector 210 detects a mean current of the input power and outputs a detection result to the controller 190. The mean current detector 210 may include a resistor-capacitor (RC) filter. The RC filter has a time constant of more than 10 cycles of a frequency of the input power.

Referring back to FIG. 1, the filtering unit 120 filters a high frequency signal of the input power. The filtering unit 120 may include an inductor-capacitor (LC) filter to filter a high frequency pulse type signal of the input power.

The switching unit 130 performs a switching operation to supply the input power provided by the power supply 100 and/or the filtering unit 120 to the heating roller 140. The switching unit 130 may include a self turn-off component. The switching unit 130 can be formed of one of bipolar type, metal oxide semiconductor type, and Si substrate type self turn-off components. When the switching unit 130 is formed of a self turn-off component, a turn-on or turn-off switching operation to supply power is automatically performed in response to a control signal of the controller 190.

The heating roller 140 is heated by the input power supplied by the power supply 100. The heating roller 140 may include, for example, heating lamps.

The input voltage detector 150 detects an input voltage of the input power supplied by the power supply 100 and outputs a detection result to the synch signal generator 160 and the root mean square value detector 170.

The synch signal generator 160 generates a power synch signal corresponding to the input voltage detected by the input voltage detector 150 and outputs the generated power synch signal to the root mean square value detector 170 and to the controller 190, for example, a second controller 194. The synch signal generator 160 generates a pulse signal to synchronize with a zero-crossing time of the input power as the power synch signal.

Using the power synch signal generated by the synch signal generator 160, the root mean square value detector 170 detects a root mean square value of the input voltage detected by the input voltage detector 150 and outputs a detection result to the second controller 194.

The temperature sensor 180 senses a temperature of the heating roller 140 and outputs the sensed temperature to the controller 190, for example, a third controller 196. A thermistor may be used as the temperature sensor 180.

The controller 190 controls the switching operation of the switching unit 130. The controller 190 may include a first controller 192, the second controller 194, and the third controller 196.

The first controller 192 controls the switching operation of the switching unit 130 in response to the instantaneous current detected by the current detector 110. When the instantaneous current detected by the current detector 110 exceeds a predetermined threshold current, the first controller 192 outputs a control signal to control the switching unit 130 perform a switch-off operation. An inrush current may be instantaneously supplied during an initial heating of the heating roller 140, resulting in a flicker phenomenon. Thus, the predetermined threshold current of a current flowing through the heating roller 140 in the initial operation is set, and if a current higher than the predetermined threshold current flows through the heating roller 140, the first controller 192 controls the switching operation of the switching unit 130 such that a current below the predetermined threshold current flows through the heating roller 140. To do this, the first controller 192 may include a comparator (not illustrated) to compare the input current to the predetermined threshold current.

The second controller 194 detects a time-based voltage variation of the input power using the root mean square value detected by the root mean square value detector 170 and the power synch signal generated by the synch signal generator 160 and controls the switching operation of the switching unit 130 in response to the detected voltage variation. The second controller 194 detects a voltage variation of the effective value input from the root mean square value detector 170 in every predetermined time interval in response to the power synch signal. If it is assumed that every predetermined time interval is a first time interval, the first time interval may be shorter than one cycle of a frequency of the input power. Thus, the second controller 194 controls the switching operation according to the voltage variation in every first time interval.

If the voltage variation detected in every first time interval is gradually increasing, the second controller 194 controls the switching operation of the switching unit 130 to decrease the input power supplied to the heating roller 140, and if the voltage variation detected in every first time interval is gradually decreasing, the second controller 194 controls the switching operation of the switching unit 130 to increase the input power supplied to the heating roller 140. Thus, the second controller 194 may control the switching operation according to the voltage variation using a feed-forward compensation method.

The third controller 196 detects a time-based temperature variation from the temperature sensed by the temperature sensor 180 and controls the switching operation of the switching unit 130 in response to the detected temperature variation and the mean current detected by the current detector 110. The third controller 196 outputs a control signal to control the supply of input power according to the temperature variation and controls the switching operation of the switching unit 130 using the control signal and the mean current detected by the current detector 110. For example, if the third controller 196 determines that the temperature sensed by the temperature sensor 180 decreases, the third controller 196 outputs a control signal to make the switching unit 130 perform a switch-on operation, and if the third controller 196 determines that the temperature sensed by the temperature sensor 180 increases, the third controller 196 outputs a control signal to make the switching unit 130 perform a switch-off operation, so that a switching on and off period of the switching operation of the switching unit 130 is controlled and adjusted.

The third controller 196 receives the mean current detected by the current detector 110 in every second time interval. The second time interval may be set to a range of, for example, 10 to 20 cycles of the frequency of the input power. In addition, the third controller 196 detects the temperature variation from the temperature sensed by the temperature sensor 180 in every third time interval. The second time interval may be shorter than the third time interval. The third time interval may be set to be in a range of, for example, 1 to 2 seconds.

Figure 3:
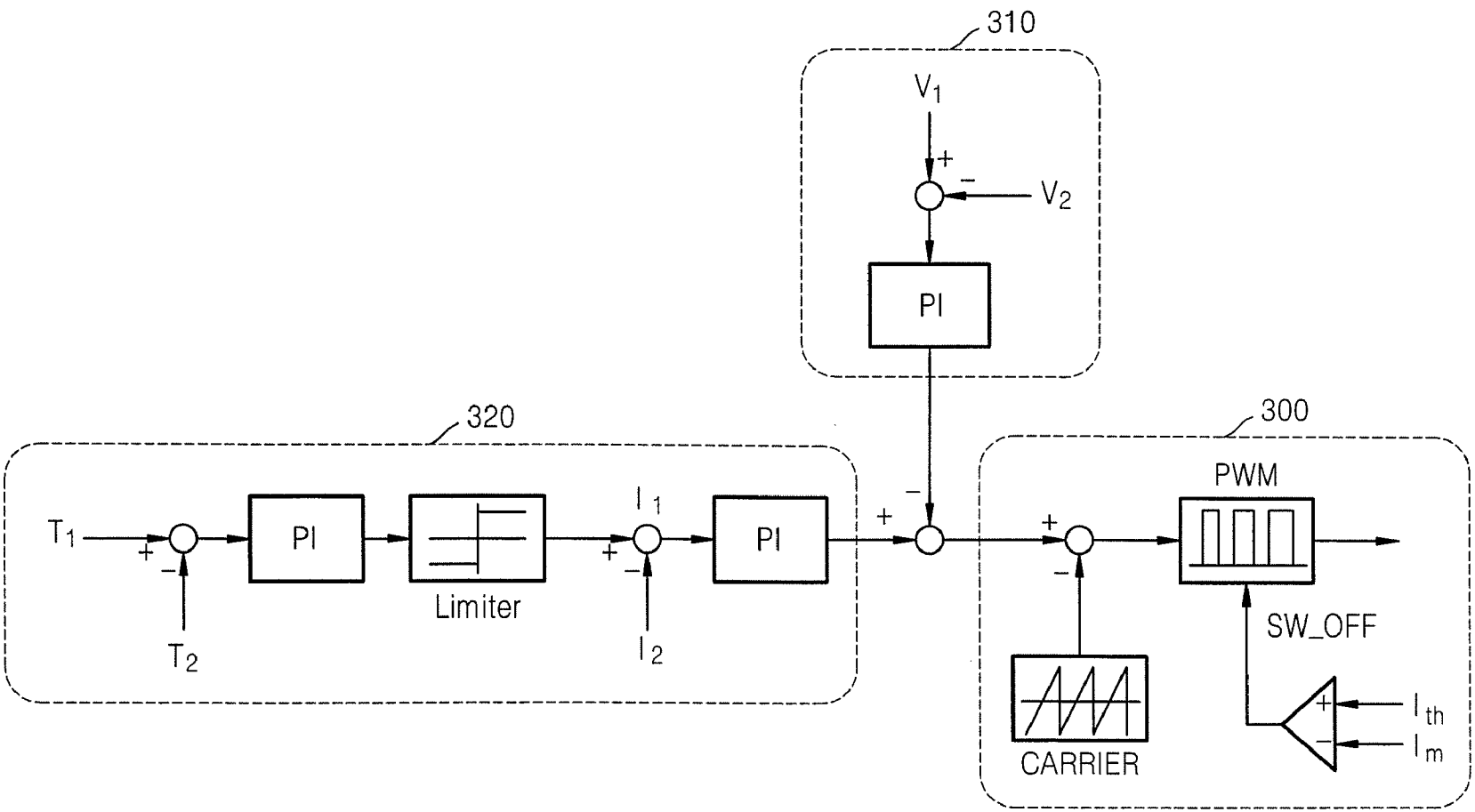
FIG. 3 is a block diagram illustrating a controller of the system illustrated in FIG. 1, according to an embodiment of the present general inventive concept.

FIG. 3 is a block diagram of the controller 190 of the system illustrated in FIG. 1, according to an embodiment of the present general inventive concept. Referring to FIG. 3, the controller 190 may include a first controller 300, a second controller 310, and a third controller 320. The first controller 300 may include a comparator to compare an instantaneous current $I_m$ to a threshold current $I_{th}$, a carrier to generate a carrier frequency, a first adder (or subtractor) to add (or subtract) the carrier frequency and a signal from the second and third controllers 310 and 320, and a PWM generator to generate a PWM signal as the control signal using the added signal and the comparison result, and controls the switching unit 130 of FIG. 1 according to the PWM signal.

The first controller 300 may have a first control cycle significantly shorter than a second control cycle of the second controller 310 or a third control cycle of the third controller 320. The second controller 310 may include a proportional integral controller to detect a voltage variation from a current input voltage $V_1$ and a previous input voltage $V_2$ and controls the switching operation of the switching unit 130 in response to the detected voltage variation. In particular, the second controller 310 may include a second adder (subtractor) to add (subtract) the current input voltage $V_1$ and the previous input voltage $V_2$ and a phase inverter PI to invert a phase of the added signal to generate the signal to be transmitted to a middle adder (subtractor). That is, if the detected voltage variation is gradually increasing, the second controller 310 controls the switching operation of the switching unit 130 to decrease the input power supplied to the heating roller 140, and if the detected voltage variation is gradually decreasing, the second controller 310 controls the switching operation of the switching unit 130 to increase the input power supplied to the heating roller 140. The second control cycle of the second controller 310 may be longer the first control cycle that of the first controller 300 and shorter than the third control cycle of the third controller 320. As described in FIG. 3, the second controller 310 may control the first controller 300 and the third controller 320 in a feed-forward compensation manner.

The third controller 320 may include a proportional integral controller to detect a temperature variation due to a difference between a current temperature $T_1$ and a previous temperature $T_2$ and outputs a control signal $I_1$ according to the detected temperature variation. The third controller 320 may include a third adder (subtractor) to add (subtract) the current temperature $T_1$ and a previous temperature $T_2$ and a phase inverter PI to invert a phase of the added signal to generate the signal to be transmitted to a limiter to determine a current limit reference value of the output control signal $I_1$. If the third controller 320 determines, by using the output control signal $I_1$ and a mean current $I_2$ detected by the current detector 110, that a temperature decreases, the third controller 320 controls the switching unit 130 to perform the switch-on operation. The output control signal $I_1$ and the mean current $I_2$ are added (subtracted) in a fourth adder (subtractor), and an additional phase inverter PI inverts a phase of the added signal to generate the signal to be transmitted to a middle adder (subtractor). Conversely, if the third controller 320 determines that a temperature increases, the third controller 320 controls the switching unit 130 to perform the switch-off operation. The control cycle of the third controller 320 may be longer than that of the first controller 300 or the second controller 310.

When the first control cycle of the first controller 300 is shortest, and the second control cycle of the second controller 310 is longer than the first control cycle of the first controller 300 and shorter than the third control cycle of the third controller 320, and the third control cycle of the third controller 320 is longest, every time an instantaneous current is detected, the first controller 300 controls the switching operation of the switching unit 130, and when the second control cycle of the second controller 310 begins, the second controller 310 controls the switching operation of the switching unit 130, and when the third control cycle of the third controller 320 begins, the third controller 320 controls the switching operation of the switching unit 130. Thus, multiple independent controls can be realized using the first controller 300, the second controller 310, and the third controller 320, according to an embodiment of the present general inventive concept.

Figure 4A:
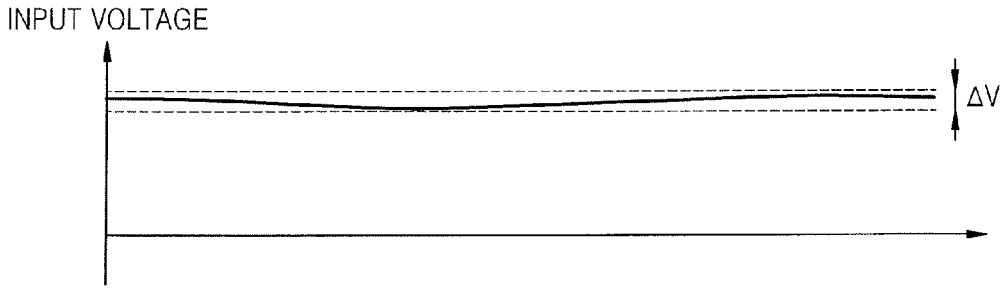
FIGS. 4A and 4B are waveform diagrams respectively illustrating a voltage variation of an input power and a current variation of the input power supplied to a heating roller of the system illustrated in FIG. 1, according to an embodiment of the present general inventive concept.
Figure 4B:
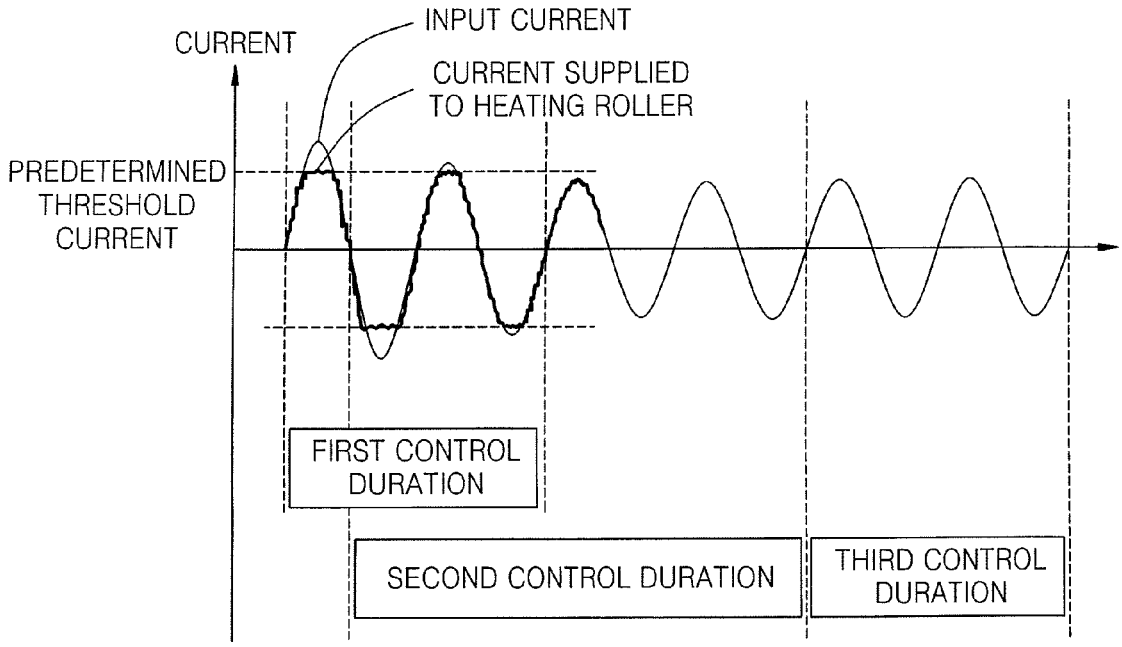

FIGS. 4A and 4B are waveform diagrams illustrating a voltage variation of an input power and a current variation of the input power supplied to the heating roller 140 of the system of FIG. 1, according to an embodiment of the present general inventive concept. As illustrated in FIG. 4A, if a voltage variation ΔV occurs in a voltage of the input power, the second controller 310 controls the switching unit 130 in every predetermined control cycle in a time period during which the voltage variation ΔV occurs. In addition, as illustrated in FIG. 4B, if a current of the input power exceeds a predetermined threshold current, the first controller 300 controls the switching unit 130 to perform the switch-off operation, thereby controlling an actual current of the input power supplied to the heating roller 140 to be below a predetermined threshold current.

As illustrated in FIG. 4B, the first controller 300 controls the switching unit 130 during an initial time to apply power to the heating roller 140, i.e., in a first control duration (i.e., a first control time period or a first control cycle), and then, the second controller 310 controls the switching unit 130 in a second control duration (i.e., a second control time period or a second control cycle), and then, the third controller 320 controls the switching unit 130 in a third control duration (i.e., a third control time period or a third control cycle).

Figure 5:
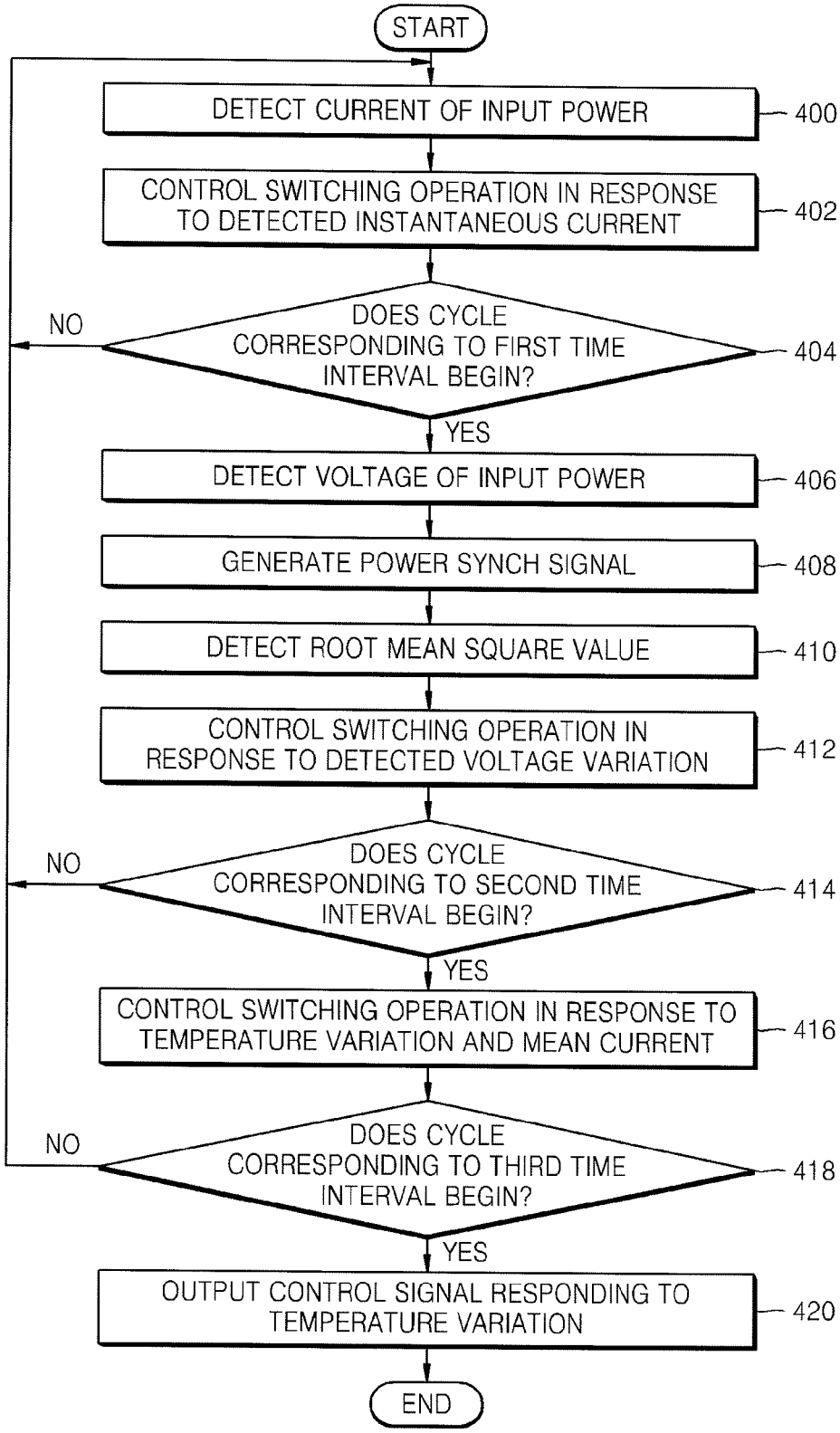
FIG. 5 is a flowchart illustrating a method of controlling a temperature of a fixing unit using the system illustrated in FIG. 1, according to an embodiment of the present general inventive concept.

FIG. 5 is a flowchart illustrating a method of controlling a temperature of a fixing unit using the system illustrated in FIG. 1, according to an embodiment of the present general inventive concept.

Referring to FIG. 5, a current of the input power to heat the heating roller 140 is detected in operation 400. Specifically, an instantaneous current and a mean current of the input power are detected.

In response to the detected instantaneous current of the input power, a switching operation of the switching unit 130 to switch a supply of the input power is controlled in operation 402. If the detected instantaneous current exceeds a predetermined threshold current, the switching unit 130 is controlled to perform the switch-off operation.

It is determined in operation 404 whether a cycle of a first time interval, corresponding to a time interval in which the second controller 194 performs a control operation, begins. The cycle of the first time interval is set to a value below one cycle of a frequency of the input power. If it is determined that the cycle of the first time interval does not begin, this process goes back to operation 400.

If it is determined that the cycle of the first time interval begins, an input voltage of the input power is detected in operation 406.

In operation 408, a power synch signal of the detected input voltage is generated.

In operation 410, a root mean square value of the detected input voltage is detected.

In operation 412, a time-based voltage variation is detected using the detected root mean square value and the generated power synch signal, and the switching operation of the switching unit 130 is controlled in response to the detected voltage variation. If the voltage variation increases, the switching operation of the switching unit 130 is controlled to decrease the input power supplied to the heating roller 140.

In operation 414, it is determined whether a cycle of a second time interval, corresponding to a time interval in which the third controller 196 performs a control operation, begins. The cycle of the second time interval is longer than the cycle of the first time interval. If it is determined that the cycle of the second time interval does not begin, the process goes back to operation 400.

If it is determined that the cycle of the second time interval begins, a temperature of the heating roller 140 is sensed, a time-based temperature variation is detected from the sensed temperature, and the switching operation of the switching unit 130 is controlled in response to the detected temperature variation and the detected mean current of the input power in operation 416.

In operation 418, it is determined whether a cycle of a third time interval, corresponding to a time interval in which the third controller 196 performs a control operation, begins. The cycle of the third time interval is longer than the cycle of the second time interval. If it is determined that the cycle of the third time interval does not begin, the process goes back to operation 400.

If it is determined that the cycle of the third time interval begins, a control signal responding to the temperature variation is output in operation 420. The control signal responding to the temperature variation is used as a signal to control the switching operation of the switching unit 130 together with the detected mean current.

Figure 6:
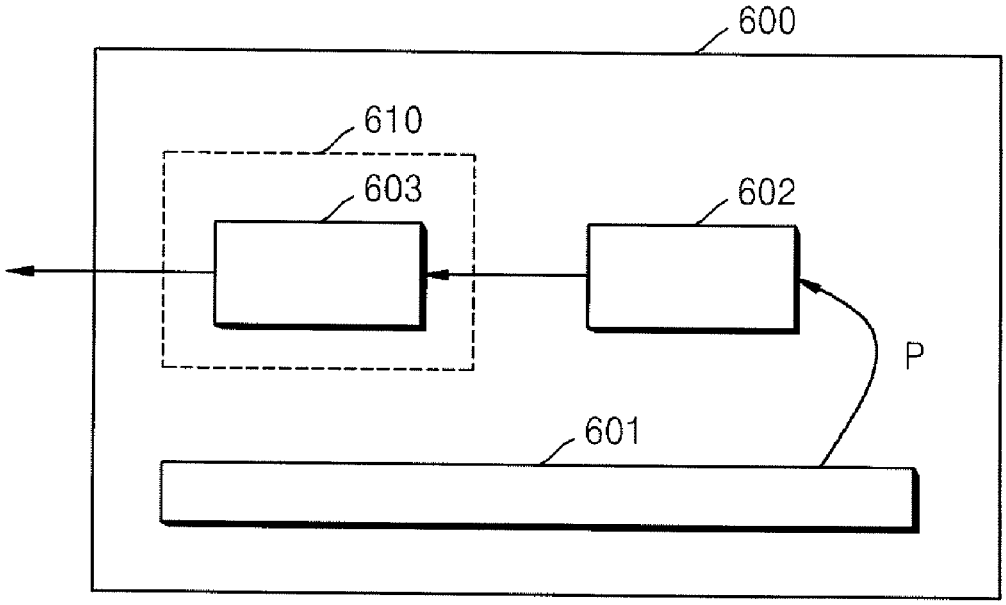
FIG. 6 is a view illustrating an image forming apparatus including the system of FIG. 1, according to an embodiment of the present general inventive concept.

FIG. 6 is a view illustrating an image forming apparatus 600 including a system 610 to control a temperature of a fixing unit 603, according to an embodiment of the present general inventive concept. As illustrated in FIG. 6, the image forming apparatus 600 may include a printing unit 602 to print an image on a printing medium P, a printing medium feeding cassette 601 to feed the printing medium P to the printing unit 602, the fixing unit 603 to fix the image printed on the printing medium (such as by using heat and pressure), and the system 610. For example, the system 610 may include the current detector 110, the filtering unit 120, the switching unit 130, the temperature sensor 180, the controller 190, the input voltage detector 150, the synch (sync) signal generator 160, and the root mean square value detector 170, as illustrated in FIG. 1. Although FIG. 6 illustrates the system 610 within the image forming apparatus 600, the present general inventive concept is not so limited. Thus, the system 610 may be disposed outside of the image forming apparatus 600. In the present embodiment, the system 610 may receive signals from the current detector 110, the temperature sensor 180, the synch (sync) signal generator 160, and/or the root mean square value detector 170 to control the temperature of the fixing unit 603.

The embodiments of the present general inventive concept can be written as codes/instructions/programs and can be implemented in general-use digital computers that execute the codes/instructions/programs using a computer readable recording medium. Examples of the computer readable recording medium include magnetic storage media (e.g., ROM, floppy disks, hard disks, etc.), optical recording media (e.g., CD-ROMs, or DVDs), and storage media such as carrier waves (e.g., transmission through the Internet). The computer readable recording medium can also be distributed over network coupled computer systems so that the computer readable code is stored and executed in a distributed fashion. Also, functional programs, codes, and code segments for accomplishing the present general inventive concept can be easily construed by programmers skilled in the art to which the present general inventive concept pertains.

As described above, in a system and method of controlling a temperature of a fixing unit according to the present general inventive concept, by controlling a supply of power to gradually increase by current limit control in an initial warm-up operation of the fixing unit, an excessive current in an initial stage can be prevented.

In addition, by performing a control response to a voltage variation by detecting a variation of input voltage of the input power, a flicker characteristic can be reduced.

In addition, after a predetermined time in which a positive temperature coefficient (PTC) of heating lamps of a heating roller increases, maximum power is supplied to the heating roller to minimize a warm-up time, and in continuous printing, temperature control continues, thereby obtaining optimal performance.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A system to control a temperature of a fixing unit usable in an image forming apparatus, the system comprising:

a current detector to detect a current of an input power to heat a heating roller;

a switching unit to perform a switching operation to switch a supply of the input power to the heating roller; and a controller to control the switching operation of the switching unit in response to an instantaneous current detected by the current detector, wherein the switching unit comprises a self turn-off component.

2. The system of claim 1, wherein the current detector comprises:

an instantaneous current detector to detect the instantaneous current of the input power; and a mean current detector to detect a mean current of the input power, wherein the instantaneous current detector comprises a full rectification circuit and the mean current detector comprises a resistor-capacitor filter.

3. The system of claim 2, wherein the controller outputs a control signal to control the switching unit to perform a switch-off operation when the instantaneous current detected by the current detector exceeds a predetermined threshold current.

4. The system of claim 3, wherein the controller comprises a circuit to compare the instantaneous current to the predetermined threshold current.

5. The system of claim 1, further comprising:

a filtering unit to filter a high frequency signal of the input power.

6. The system of claim 5, wherein the filtering unit comprises an inductor-capacitor filter.

7. The system of claim 1, further comprising:

an input voltage detector to detect an input voltage of the input power;

a synch signal generator to generate a power synch signal of the detected input voltage;

a root mean square value detector to detect a root mean square value of the detected input voltage; and a second controller to detect a time-based voltage variation of the input power using the detected root mean square value and the generated power synch signal and to control the switching operation of the switching unit in response to the detected voltage variation.

8. The system of claim 7, wherein the second controller controls the switching operation of the switching unit to decrease a supply of the input power supplied to the heating roller if the voltage variation increases.

9. The system of claim 7, wherein the second controller performs a control response according to the voltage variation in every first time interval corresponding to a time interval shorter than one cycle of a frequency of the input power.

10. The system of claim 7, wherein the second controller performs a control response according to the voltage variation using a feed-forward compensation method.

11. The system of claim 1, further comprising:

a temperature sensor to sense a temperature of the heating roller; and a third controller to detect a time-based temperature variation from the temperature sensed by the temperature sensor and to control the switching operation of the switching unit in response to the detected temperature variation and a mean current detected by the current detector.

12. The system of claim 11, wherein the third controller controls the switching operation of the switching unit using a control signal in response to a mean current detected in every second time interval and a temperature variation detected in every third time interval.

13. The system of claim 12, wherein the second time interval is shorter than the third time interval.

14. A method of controlling a temperature of a fixing unit, the method comprising:

detecting a current of an input power to heat a heating roller; and controlling a switching operation of a switching unit to switch a supply of the input power in response to a detected instantaneous current of the input power, wherein the switching unit comprises a self turn-off component.

15. The method of claim 14, wherein the detecting of the current comprises:

detecting an instantaneous current and a mean current of the input power.

16. The method of claim 14, wherein the controlling of the switching operation comprises:

controlling the switching unit to perform a switch-off operation when the detected instantaneous current exceeds a predetermined threshold current.

17. The method of claim 14, further comprising:

detecting an input voltage of the input power;

generating a power synch signal of the detected input voltage;

detecting a root mean square value of the detected input voltage; and detecting a time-based voltage variation of the input power using the detected root mean square value and the generated power synch signal and controlling the switching operation of the switching unit in response to the detected voltage variation.

18. The method of claim 17, wherein the controlling of the switching operation of the switching unit comprises:

controlling the switching operation of the switching unit to decrease the input power supplied to the heating roller if the voltage variation increases.

19. The method of claim 17, wherein the controlling of the switching operation of the switching unit comprises:

performing a control response according to the voltage variation in every first time interval corresponding to a time interval shorter than one cycle of a frequency of the input power.

20. The method of claim 17, wherein the controlling of the switching operation of the switching unit comprises:

performing a control response according to the voltage variation using a feed-forward compensation method.

21. The method of claim 14, further comprising:

sensing a temperature of the heating roller; and detecting a time-based temperature variation from the sensed temperature and controlling the switching operation of the switching unit in response to the detected temperature variation and the detected mean current of the input power.

22. The method of claim 21, wherein the controlling of the switching operation of the switching unit comprises:

controlling the switching operation of the switching unit using a control signal responding to a mean current detected in every second time interval and a temperature variation detected in every third time interval.

23. The method of claim 22, wherein the second time interval is shorter than the third time interval.

24. A computer readable recording medium storing a computer readable program to execute a method of controlling a temperature of a fixing unit, the method comprising:

detecting a current of an input power to heat a heating roller; and controlling a switching operation of a switching unit to switch a supply of the input power in response to a detected instantaneous current of the input power, wherein the switching unit comprises a self turn-off component.

25. A system to control a temperature of a fixing unit of an image forming apparatus, the system comprising:

a current detecting unit to detect an instantaneous current of an input power;

a voltage detecting unit to detect a voltage of the input power;

a switching unit to switch a power of the input power to a fixing unit; and a control unit to control the switching unit to switch between a turn-on state and a turn-off state according to the detected instantaneous current and the detected voltage.

26. The system of claim 25, wherein the current detecting unit detects an instantaneous current and a mean current of the input power as the current, and the controller controls the switching unit according to the detected instantaneous current and mean current.

27. The system of claim 25, further comprising:

a synch signal generator to generate a power synch signal of the detected input voltage;

a root mean square value detector to detect a root mean square value of the detected input voltage; and wherein the control unit to detect a time-based voltage variation of the input power using the detected root mean square value and the generated power synch signal and to control the switching operation of the switching unit in response to the detected voltage variation.

28. The system of claim 25, further comprising:

a temperature detecting unit to detect a temperature of the fixing unit, wherein the control unit controls the switching unit to switch between the turn-on state and the turn-off state according to the detected temperature.

29. The system of claim 28, wherein the control unit controls the switching unit to switch between the turn-on state and the turn-off state according to the detected current during a first time period, controls the switching unit to switch between the turn-on state and the turn-off state according to the detected voltage during a second time period, and controls the switching unit to switch between the turn-on state and the turn-off state according to the detected temperature during a third time period.

30. The system of claim 29, wherein the control unit comprises:

a first controller to control the switching unit to switch between the turn-on state and the turn-off state based on the detected current during the first time period;

a second controller to control the switching unit to switch between the turn-on state and the turn-off state based on the detected voltage during the second time period; and a third controller to control the switching unit to switch between the turn-on state and the turn-off state based on the detected temperature during the third time period.

31. The system of claim 29, wherein the second time period is longer than the first time period and shorter than the second time period.

32. A method of controlling a temperature of a fixing unit of an image forming apparatus, the method comprising:

detecting an instantaneous current of an input power;

detecting a voltage of the input power; and controlling a switching unit to switch between a turn-on state to supply the input power to the fixing unit and a turn-off state to prevent the supply of the input power to the fixing unit according to the detected instantaneous current and the detected voltage.

33. The method of claim 32, further comprising:

detecting a temperature of the fixing unit; and controlling the switching unit to switch between the turn-on state and the turn-off state according to the detected temperature.

34. The method of claim 33, further comprising:

controlling the switching unit to switch between the turn-on state and the turn-off state according to the detected current during a first time period;

controlling the switching unit to switch between the turn-on state and the turn-off state according to the detected voltage during a second time period; and controlling the switching unit to switch between the turn-on state and the turn-off state according to the detected temperature during a third time period.

35. A computer readable recording medium storing a computer readable program to execute a method of controlling a temperature of a fixing unit of an image forming apparatus, the method comprising:

detecting an instantaneous current of an input power;

detecting a voltage of the input power; and controlling a switching unit to switch between a turn-on state to supply the input power to the fixing unit and a turn-off state to prevent the supply of the input power to the fixing unit based on the detected instantaneous current and the detected voltage.

36. The system of claim 1, wherein the switching unit is formed one of bipolar type, metal oxide semiconductor type, and Si substrate type self turn-off components.

37. The system of claim 1, wherein a turn-on or turn-off switching operation of the switching unit to supply power is automatically performed in response to a control signal of the controller.

38. The method of claim 14, wherein the switching unit is formed one of bipolar type, metal oxide semiconductor type, and Si substrate type self turn-off components.

39. The computer readable recording medium of claim 24, wherein the switching unit is formed one of bipolar type, metal oxide semiconductor type, and Si substrate type self turn-off components.

40. The system of claim 25, wherein the switching unit comprises a self turn-off component.

41. The system of claim 40, wherein the switching unit is formed one of bipolar type, metal oxide semiconductor type, and Si substrate type self turn-off components.

42. The system of claim 25, wherein a turn-on or turn-off switching operation of the switching unit to supply power is automatically performed in response to a control signal of the controller.

43. The system of claim 25, wherein the control unit outputs a control signal to control the switching unit to perform a switch-off operation when the instantaneous current detected by the current detector exceeds a predetermined threshold current.

44. The method of claim 32, wherein the switching unit comprises a self turn-off component.

45. The method of claim 44, wherein the switching unit is formed one of bipolar type, metal oxide semiconductor type, and Si substrate type self turn-off components.

* * * * *